United States Patent [19]

Florian

[11] Patent Number: 4,923,573

[45] Date of Patent: May 8, 1990

[54] METHOD FOR THE ELECTRO-DEPOSITION OF A ZINC-NICKEL ALLOY COATING ON A STEEL BAND

[75] Inventor: Theodor Florian, Melsbach, Fed. Rep. of Germany

[73] Assignee: Rasselstein AG, Neuwied, Fed. Rep. of Germany

[21] Appl. No.: 343,528

[22] Filed: Apr. 26, 1989

[30] Foreign Application Priority Data

May 13, 1988 [DE] Fed. Rep. of Germany ..... 3816419

[51] Int. Cl.[5] ..... C25D 3/56; C25D 7/06

[52] U.S. Cl. ..... 204/28; 204/44.2

[58] Field of Search ..... 204/27, 28, 44.2

[56] References Cited

U.S. PATENT DOCUMENTS 4,249,999 2/1981 Tsuda ..... 204/28

4,313,802 2/1982 Shibuya ..... 204/28

*Primary Examiner*—T. M. Tufariello

*Attorney, Agent, or Firm*—Flynn, Thiel, Boutell & Tanis

[57] ABSTRACT

In the method for the electro-deposition of a zinc-nickel alloy coating on a steel band, electrolytic nickel anodes and an electrolyte as free from chloride as possible and containing $Zn^{2+}$ and $Ni^{2+}$ ions is used. Operation is at current densities of at least 10 $A/dm^2$, the metal content removed being replaced constantly during operation.

12 Claims, No Drawings

METHOD FOR THE ELECTRO-DEPOSITION OF A ZINC-NICKEL ALLOY COATING ON A STEEL BAND

The invention concerns a method for the electro-deposition of a zinc-nickel alloy coating on a steel band in an electrolyte which contains $Zn^{2+}$ and $Ni^{2+}$ ions, using at least one metal anode at current densities of at least 10 $A/dm^2$, the metal content removed being constantly replaced.

For the electro-deposition of zinc-nickel alloy coatings with 3–15% nickel, preferably 10–12% nickel, basically two different methods are known, which are both described in German Pat. No. 30 05 159. In the first method an electrolyte with at least one insoluble anode is used, wherein additional $Ni^{2+}$ and $Zn^{2+}$ ions are supplied to the electrolyte during operation in the form of basic salts of the metals. Anodes made of lead or lead alloys, e.g. lead which contains silver, are used as insoluble anodes. Lead and its alloys have the disadvantage that while the method is being carried out, during electrolysis some of the lead is dissolved in the electrolyte. As lead ions reduce the corrosion resistance of zinc-nickel coatings even at low concentrations in the electrolyte, the lead ions must be removed from the electrolyte by zinc dust purification or precipitation with strontium sulphate (German patent application No. 30 11 991). These additional measures, however, make the plating process expensive.

The use of titanium anodes which are coated with platinum metals and/or oxides thereof is also known. The use of such coated titanium anodes is expensive, however, as the noble metal coating is slightly dissolved during electrolysis and consequently has to be renewed from time to time. Moreover the noble metal coating can also be worn away from the titanium by mechanical damage, which can be caused e.g. by insufficient tension of the steel band as it moves up to the apparatus.

The advantages of soluble anodes made of zinc, nickel and alloys thereof are, amongst others, low metal costs. However, during electrolytic dissolution at high current densities are formed, particularly at the nickel anodes, metal spangles which have to be removed from the electrolyte, as they would impair the quality of the zinc-nickel coatings. Moreover the zinc content of the electrolyte increases, due to chemical dissolution of the zinc anodes.

It is therefore the object of the invention to indicate a method for the electro-deposition of a zinc-nickel alloy coating on a steel band of the kind mentioned hereinbefore, in which contamination of the electrolyte by extraneous metal ions or anode spangles is avoided and which therefore allows in a particularly easy manner the production of satisfactory coatings with high corrosion resistance.

According to the invention, this is achieved by the fact that electrolytic nickel anodes are used as the anodes, and an electrolyte as free from chloride as possible is used.

Electrolytic nickel, also called cathode nickel, is electrolytically refined, particularly pure, at least 99.5% nickel. Unactivated nickel of this kind has a tendency towards high passivation in normal electrolytes which contain no or only few chloride ions by forming a protective layer. Passivation protects the electrolytic nickel anodes from rapid dissolution. It is important here that the electrolyte should be as free from chloride as possible, as so-called pitting at the anodes and hence also spangle formation is caused by chloride. Moreover, chloride ions would accelerate dissolution of the electrolytic nickel anode. The passivating layer does not completely prevent dissolution of the electrolytic nickel anodes, but only slows it down. A low anodic efficiency of below 10% was detected, so that the electrolytic nickel anodes have a long working life. Due to the use of these electrolytic nickel anodes, the carry-over of obtrusive extraneous metal ions and moreover also spangle formation is avoided. The nickel ions which are slowly released from the electrolytic nickel anodes serve to replace the metal content of the electrolyte desirably.

In order to avoid rapid dissolution of the electrolytic nickel anodes and possibly pitting, an electrolyte whose chloride content is below 300 mg/l, preferably below 50 mg/l, should be used. Such a low chloride content is usually unavoidable under large-scale industrial conditions on account of contamination of the deposit salts.

Since only partially soluble electrolytic nickel anodes are used in the method according to the invention, the metal content removed must be constantly replaced during operation. This takes place advantageously in such a way that the metal content in the electrolyte is replaced by anodic dissolution of the metals in a separate tank, by pumping the electrolyte in a circuit from a plating tank into the separate tank and back, nickel activated by added elements being used as the anode material. The preparation of a chloride-free electrolyte is possible in a similar way.

It is known that certain elements added in very small quantities increase the anodic activity of nickel. Thus, the activity can be improved by addition of carbon, silicon, iron, manganese, selenium, tellurium and phosphorus. Nickel activated with sulphur proved to be particularly suitable as an anode material, wherein nickel containing about 0.03% sulphur is used advantageously, cf. A. C. Hart, "Anodic dissolution of nickel in nickel sulphate/nickel chloride electrolytes," Metalloberflache 4/74, pages 135–139.

The use of activated nickel in anodic dissolution of metals is especially significant in connection with the use of electrolytes which are as free from chloride as possible. A condition of carrying out the actual plating method is in fact an electrolyte as free from chloride as possible. This electrolyte as free from chloride as possible dissolves an electrolytic nickel anode only very slowly. Whereas this is an advantage in carrying out the actual plating method, passivation of the electrolytic nickel anode in anodic dissolution would prove unsuitable for replacement of the nickel removed from the electrolyte, because dissolution would proceed far too slowly, especially in chloride-free or low-chloride electrolytes. On the other hand, nickel activated with sulphur can be dissolved rapidly anodically in electrolytes of this kind, even at high current densities.

In normal replacement of the metals removed from the electrolyte during operation, the cathodically deposited zinc and nickel are replaced by chemical dissolution of zinc oxide or zinc carbonate and nickel carbonate in a separate tank in a bypass. Since even minor extraneous metal impurities of, inter alia, lead, cadmium, copper, arsenic and antimony can impair the corrosion resistance of the deposited zinc-nickel alloy coatings, the metal salts used for replacement must meet high purity requirements. By contrast, the anodic dissolution of zinc and activated nickel to replace the removed zinc and nickel ions is a cheap and environment-friendly alternative. The costs for the metals are lower than for salts with the same degree of chemical purity. The anode metals have high chemical purity. The zinc and nickel contents of the electrolyte fluctuate only slightly. The zinc and nickel content of the electrolyte can be replaced and kept constant by appropriate dimensioning of the electrode surfaces in the separate tank and the level of electric current. The electrolyte is pumped in a circuit from the separate tank via a filter into the plating tank and back, whereby the differences in concentration in the different tanks are kept low. Anodic dissolution of metals furthermore has the advantage that with this method no carcinogenic products, e.g. nickel carbonate, are used.

The zinc-nickel content in the electrolyte can also if necessary be replaced by anodic dissolution of zinc-nickel alloys.

The method according to the invention can be combined with the types of apparatus described in patent literature for electro-deposition at high current densities (see e.g. European Pat. No. B1-61 130 and European Pat. No. A1-101 429).

The method according to the invention is carried out under the following conditions:

| | | |
|---|---|---|
| zinc sulphate | 10–70 g/l $Zn^{2+}$ | preferably 30–50 g/l $Zn^{2+}$ |
| nickel sulphate | 30–110 g/l $Ni^{2+}$ | preferably 50–80 g/l Ni2+ |
| sodium sulphate | 0–150 g/l | preferably 70–120 g/l |
| pH value | 0.8–2.2 | preferably 1.5–2.0 |
| chloride | <100 mg/l | preferably <30 mg/l |
| bath temperature | 20–80° C. | preferably 40–65° C. |
| electrolyte speed | 10–500 m/min | preferably 50–200 m/min |
| current density: | | |
| process bath | 10–200 A/dm$^2$ | preferably 20–50 A/dm$^2$ |
| replacement bath | <8 A/dm$^2$ (pH 1.5) | preferably <5 A/dm$^2$ |

A surface active agent can be added to the electrolyte. With apparatuses of the type with reduced electrolyte level (see e.g European Pat. No. B1-61 130 and European Pat. No. A1-101 429) a slightly foaming surface-active agent can be added, e.g. ethylhexyl sulphate 1–1000 mg/l preferably 50–200 mg/l.

In conventional band processing apparatuses with dipping, highly foaming surface-active agents can be added, such as sodium lauryl sulphate 1–1000 mg/l preferably 50–100 mg/l anion-active fluorine-based surface-active agents 1–1000 mg/l preferably 50–100 mg/l.

EXAMPLE

| | | | |
|---|---|---|---|
| electrolytic deposit: | 50 g/l | $Zn_{2+}$ as $ZnSO_4$ | |
| | 60 g/l | $Ni_{2+}$ as $NiSO_4$ | |
| | 100 g/l | $Na_2SO_4$ | |
| | 50 mg/l | ethylhexyl sulphate | |
| electrolysis conditions: | bath temperature | | 60° |
| | pH value | | 1.5 |
| | current density: | | |
| | - process bath | | 30 A/dm$^2$ |
| | - replacement bath | | 5 A/dm$^2$. |

In the bath described above, electrolytically degreased and pickled thin sheet panels were processed with 50 g/m$^2$ zinc containing 11% nickel. The corrosion resistance of the coating in the salt spray test was very good with 1000 h before the appearance of some red rust spots. Thin galvanized sheet with the same coating, on the other hand, fails already after 72 hours with red rust.

The nickel dissolution caused by the anodic efficiency of the electrolytic nickel anode of 5% was substantially less than the quantity of nickel needed for deposition of zinc with 11% nickel.

The zinc and nickel content of the electrolyte was kept constant by anodic dissolution of zinc and S-nickel in the replacement bath at current densities of 1–8 A/dm$^2$. At these current densities, hydrogen is precipitated cathodically with an efficiency of more than 95%.

I claim:

1. A method for the electro-deposition of a zinc-nickel alloy coating on a steel band in an electrolyte containing $Zn^{2+}$ and $Ni^{2+}$ ions at a current density of at least 10 A/dm$^2$ comprising the steps of:

(1) adjusting the chloride content of the electrolyte to less than 300 mg/l;

(2) passing the steel band through a plating tank containing said electrolyte and at least one metal anode consisting of electrolytic nickel having a nickel content of at least 99.5%;

(3) depositing a zinc-nickel alloy coating on said steel band from said electrolyte in said plating tank thereby depleting the content of $Zn^{2+}$ and $Ni^{2+}$ ions in said electrolyte;

(4) providing a regeneration tank in fluid communication with said plating tank, said regeneration tank containing at least one zinc anode and one nickel anode;

(5) removing said depleted electrolyte from said plating tank and introducing it into said regeneration tank;

(6) replenishing said depleted electrolyte in said regeneration tank by galvanic dissolution of said at least one zinc anode and one nickel anode; and (7) reintroducing said replenished electrolyte into said plating tank.

2. A method according to claim 1, wherein the chloride content of the electrolyte is adjusted to below 50 mg/l.

3. According to claim 1, wherein the electrolyte contains zinc sulfate, nickel sulfate and a conducting salt.

4. A method according to claim 3, wherein the pH of the electrolyte is adjusted to approximately 1.5.

5. A method according to claim 1, wherein said at least one nickel anode in the regeneration tank is activated with sulfur.

6. A method according to claim 5, wherein said at least one nickel anode contains approximately 0.03% sulfur.

7. A method according to claim 1, wherein said galvanic dissolution in said regeneration chamber is carried out at current densities of up to 8 A/dm$^2$.

8. A method according to claim 1, wherein said replenished electrolyte filtered prior to being reintroduced into said plating tank.

9. A method according to claim 1, wherein only one plating tank is used.

10. A method according to claim 1, wherein said at least one nickel anode in said regeneration chamber has a greater solubility in said electrolyte than said at least one metal anode consisting of electrolytic nickel.

11. A method according to claim 1, wherein said at least one metal anode consisting of electrolytic nickel forms a protective layer in said electrolyte.

12. A method for the electro-deposition of a zinc-nickel alloy coating on a steel band in an electrolyte containing $Zn^{2+}$ and $Ni^{2+}$ ions at a current density of at least 10 $A/dm^2$ comprising the steps of:

(1) adjusting the chloride content and the pH of the electrolyte to less than 50 mg/l and approximately 1.5 respectively;

(2) passing the steel band through a plating tank containing said electrolyte and at least one metal anode consisting of electrolyte nickel having a nickel content of at least 99.5%, said at least one metal anode forming a protective layer in said electrolyte;

(3) depositing a zinc-nickel alloy coating on said steel band from said electrolyte in said plating tank thereby depleting the content of $Zn^{2+}$ and $Ni^{2+}$ ions in said electrolyte;

(4) providing a regeneration tank in fluid communication with said plating tank, said regeneration tank containing at least one zinc anode and one nickel anode, said at least one nickel anode in said regeneration tank containing approximately 0.03% sulfur and having a higher solubility in said electrolyte than said at least one metal anode consisting of electrolytic nickel;

(5) removing said depleted electrolyte from said plating tank and introducing it into said regeneration tank;

(6) replenishing said depleted electrolyte in said regeneration tank by galvanic dissolution of said at least one zinc anode and one nickel anode, said galvanic dissolution being carried out at current densities of up to 8 $A/dm^2$;

(7) removing said replenished electrolyte from said regeneration tank and passing it through a filter; and (8) reintroducing said filtered replenished electrolyte into said plating tank.

* * * * *